US005372524A

United States Patent [19]

Yamada

[11] Patent Number: 5,372,524

[45] Date of Patent: Dec. 13, 1994

[54] RECTANGULAR MULTIPLE CONNECTOR

[75] Inventor: Akio Yamada, Tokyo, Japan

[73] Assignee: Daiichi Denshi Kogyo Kabushiki Kaisha, Tokyo, Japan

[21] Appl. No.: 36,422

[22] Filed: Mar. 24, 1993

[30] Foreign Application Priority Data

Mar. 31, 1992 [JP] Japan ..... 4-027018[U]

[51] Int. Cl.[5] ..... H01R 13/648

[52] U.S. Cl. ..... 439/607; 439/904

[58] Field of Search ..... 439/92, 95, 108, 607-610, 439/904

[56] References Cited

U.S. PATENT DOCUMENTS 4,376,922 3/1983 Muzslay ..... 439/904 X
5,037,331 8/1991 Goodman et al. ..... 439/607
5,137,472 8/1992 Hillbish et al. ..... 439/607
5,151,054 9/1992 Briones et al. ..... 439/904 X
5,174,789 12/1992 Yu et al. ..... 439/904 X

*Primary Examiner*—Khiem Nguyen
*Attorney, Agent, or Firm*—Silverman, Cass & Singer, Ltd.

[57] ABSTRACT

A rectangular multiple connector has a connector shell surrounding a contact support insulator having contacts fixed therein in two rows. The connector shell includes conductive projection members having a required rigidity provided at both the ends of the contact support insulator. Two conductive side plates are provided along side surfaces of the contact support insulator and fixed at their ends in the projection members. With this arrangement, both the ends of the connector shell having projection members mainly support torsional or bending forces created upon connecting the connector to a mating connector without occurrence of any deformation of connector shell, thereby ensuring complete connection between the contacts of the connectors.

3 Claims, 2 Drawing Sheets

RECTANGULAR MULTIPLE CONNECTOR

BACKGROUND OF THE INVENTION

The present invention relates to a rectangular multiple connector for use in an interface between miniature electronic appliances, and more particularly to a thin and flat multiple connector.

Recently, electronic appliances have been miniaturized to realize, for example, very thin personal computers of the A4 book size (210×297 mm), pocket-book size electronic appliances, and the like. With their miniaturization, very thin and narrow flat multiple connectors have been required for use in information interchange between electronic appliances and external circuits. These connectors might have dimensions such that the length is of the order of 100 mm and the width is of the order of 4 mm. FIG. 3 schematically illustrates one example of such female connector commonly used for the information interchange.

The connector shown in FIG. 3 consists of a flange 5 and an alignment fitting 4. The alignment fitting 4 comprises a contact support insulator 2 formed with an elongated rectangular aperture 21 with contacts 1 arranged in two parallel rows therein, and a connector shell 3 surrounding the contact support insulator 2. When a mating connector (not shown) connected through an interface cable to an external circuit is inserted into the elongated rectangular aperture 21 of the miniature multiple connector, the contacts 1 comes into contact with the contact of the mating connector to permit the external circuit to connect to the internal circuit of an electronic appliance connected to the tails 11 of the contacts 1.

The connector shell 3 cooperates with the connector shell of the mating connector inserted therein to prevent possible undesirable interference caused by external electromagnetic noise. At the same time the connector shell 3 resists torsional or bending forces from the mating connector so as to prevent any deformation of the contact support insulator 2 and hence any displacement of the contacts 1, thereby preventing any break in the electronic connection between aligned pair of contacts of the multiple connector and the mating connector.

In order to obtain a thin and flat connector as described above, it is required to make the width $S_1$ of the contact support insulator 2 as narrow as possible and the thickness of the sheet metal from which the connector shell 3 is fabricated should be as thin as possible. Therefore, instead of the diecasting process which is difficult to obtain thin products, the press-forming method has been used for this purpose. According to this process, a sheet metal is punched and bent to obtain a component of the connector comprising a connector shell 3 and a flange 5. On the other hand, a contact support insulator 2 is integrally formed with a flange inner member 51 and firmly fitted in the connector shell 3 so that the flange inner member 51 is also fitted in the flange 5.

In accordance with this method, by appropriately selecting the thickness of the sheet metal, the thickness of the connector can be reduced to meet the requirement of the flat connector. However, as the sheet metal used to fabricate the connector shell 3 is decreased, the rigidity of the connector shell 3 is unavoidably reduced. Eventually, the connector shell 3 becomes susceptible to torsional or bending forces from the mating connector and is unable to prevent the deformation of the contact support insulator 2. Consequently, the deformation of the contact support insulator 2 causes the contacts to be displaced and breaks the electrical connection between the aligned pairs of contacts of the connector and the mating connector, which is a decisive failure for a connector. Accordingly, the method of the prior art relying upon the use of a thinner sheet metal is unable to produce a reliable connector thinner than a certain extent.

SUMMARY OF THE INVENTION

It is an object of the invention to provide a multiple connector whose contact support insulator is difficult to be deformed by torsional or bending forces from a mating connector although the connector is very thin.

The invention resides in the discovery obtained through investigation by the inventor that both the ends A (FIG. 3) of the connector shell holding both the ends of the contact support insulator 2 are mainly subjected to the bulk of the stress applied to the connector by the torsional or bending forces from the mating connector, while both the side walls B of the connector shell serve to provide electromagnetic shielding.

In order to accomplish this object, the multiple connector according to the invention comprises a connector shell including projection members made by diecasting process or the like integrally with the flange of the connector to have the rigidity required to support both the ends of the contact support insulator and two conductive side plates having ends fixed to the projection members.

With such an arrangement, the rigid projection members 31 and 32 provided at both the ends of the contact support insulator 2 entirely support the torsional or bending forces created in connecting and disconnecting the connector with and from a mating connector. Therefore, the side plates 33 and 34 do not participate in supporting such forces so that they can be made thinner without requiring high mechanical strength. Consequently, the thin and flat multiple connector can be realized according to the invention.

The invention will be more fully understood by referring to the following detailed specification and claims taken in connection with the appended drawings.

DESCRIPTION OF THE PREFERRED EMBODIMENTS

Figure 1:
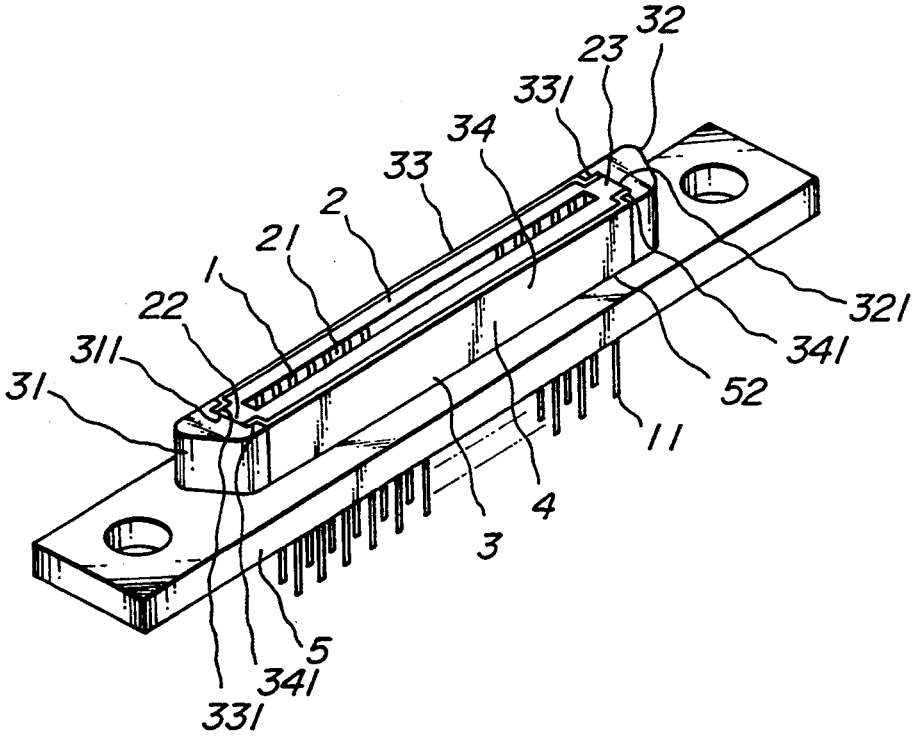
FIG. 1 is a perspective view for explaining a multiple connector according to one preferred embodiment of the invention.
Figure 3:
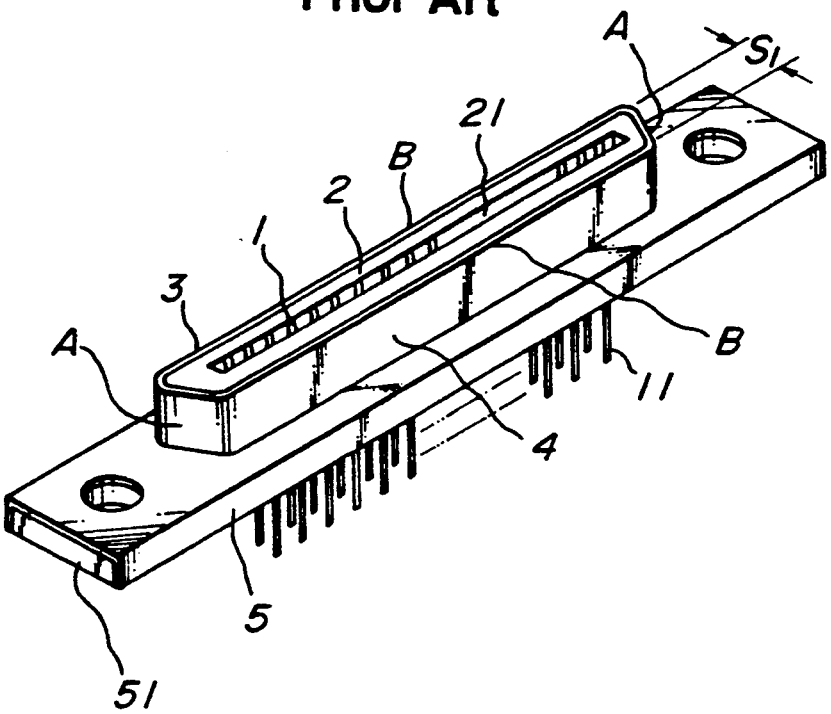
FIG 3 Prior Art

One embodiment of a multiple connector according to the invention is illustrated in FIG. 1, wherein like components are designated by the same reference numerals as those in FIG. 3. In FIG. 1, the connector comprises a contact support insulator 2 made of an insulating material which is formed with a rectangular aperture 21 having therein contacts 1 arranged in two row and at both ends with projection supports 22 and 23. Projection members 31 and 32 are provided at the projection supports 22 and 23 for forming both the ends of the alignment fitting 4. The projection members 31 and 32 are formed, for example, of an aluminum alloy by diecasting process into a triangular prism or a polygonal column and preferably formed integrally with the flange 5. Each of the projection members 31 and 32 is formed in its inside surface with a fixing recess 311 or 321 adapted to be fitted with the projection support 22 or 23 of the contact support insulator 2 as described later.

Side plates 33 and 34 are made of a nickel plated steel sheet metal having, for example, a thickness of about 0.3 mm and form a connector shell 3 with the projection members 31 and 32. The side plates 33 and 34 include at their ends bent steps 331 and 341 adapted to be fitted in the fixing recesses 311 and 321 of the projection members 31 and 32 together with the projection supports 22 and 23 of the contact support insulator 2 in order to fix the side plates thereat. The height of the side plates 33 and 34 is somewhat higher than that of the projection members 31 and 32 before assembling and bottoms of the side plates 33 and 34 are inserted into grooves 52 formed in the flange 5 in assembling, thereby improving the mechanical strength of the side plates 33 and 34 and eliminating any clearance between the flange 5 and the side plates 33 and 34 to ensure the complete electromagnetic shielding.

Figure 2:
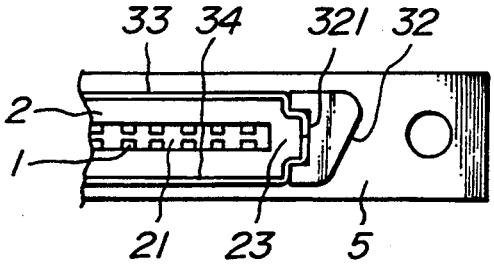
FIG. 2 is a partial plan view schematically illustrating a multiple connector according to another embodiment of the invention; and, FIG. 3 is a perspective view for explaining a multiple connector of the prior art.

While the preferred embodiment of the invention has been explained, it will be understood that various modifications may be made therein. For example, in order to fix the side plates 33 and 34 in the projection members 31 and 32, their ends are bent twice to form two steps, respectively so that their opposite ends abut against each other when they are snugly fitted in the fixing recesses 311 and 321 of the projection members 31 and 32 as shown in FIG. 2. With this arrangement, the side plates 33 and 34 is more improved in mechanical strength as a connector shell.

Although all the surfaces of the insulating block are in contact with the two projection members and the side plates in the above embodiment, it may be sufficient to support the insulating block only by the projection members in some cases. While the female multiple connector has been explained by way of example, the invention may be also applicable to male connectors.

As can be seen from the above description, the invention can provide a flat multiple connector having significant effects.

What is claimed is:

1. A rectangular multiple connector including a connector shell surrounding a contact support insulator having contacts fixed therein in at least one row, said connector shell comprising electrically conductive projection members each having a required rigidity provided at both the ends of said contact support insulator and two electrically conductive side plates provided along side surfaces of the contact support insulator and fixed at their ends in said projection members, each of said projection members is substantially in the form of a polygonal column, said contact support insulator has at its ends projection supports extending in the form of a polygonal column, and wherein said projection members are formed in their inner opposite surfaces with fixing recesses, respectively, for fixing said projection supports, and the ends of said side plates are bent to form steps which are snugly fitted and fixed in said fixing recesses of the projection members together with said projection supports of the contact support insulator.

2. The multiple connector as set forth in claim 1, wherein said connector further comprises a flange and wherein the height of said side plates is somewhat higher than that of said projection members before assembling and bottom of the side plates are inserted and fixed in grooves formed in said flange.

3. The multiple connector as set forth in claim 1, wherein said steps at the ends of the side plates are two steps so that their opposite distal ends of the bent ends of the side plates abut against each other when they are fitted in the fixing recesses of the projection members, thereby increasing the mechanical strength of the connector shell.

* * * * *